United States Patent [19]

Laganas

[11] 4,300,256

[45] Nov. 17, 1981

[54] CLOG-TYPE SHOES AND METHOD FOR THEIR PRODUCTION

[75] Inventor: Arthur Laganas, Lancaster, Ohio

[73] Assignee: R. G. Barry Corporation, Pickerington, Ohio

[21] Appl. No.: 71,494

[22] Filed: Aug. 31, 1979

[51] Int. Cl.[3] ..... A43D 9/00; A43B 3/12

[52] U.S. Cl. ..... 12/142 F; 12/142 S; 36/11.5

[58] Field of Search ..... 12/142 R, 142 F, 142 S; 36/13, 33, 86, 11.5

[56] References Cited

U.S. PATENT DOCUMENTS

| | | | |
|---|---|---|---|
| 1,963,577 | 6/1934 | Cu ozzo | 12/142 F |
| 3,584,402 | 6/1971 | Silverman | 36/11.5 |
| 3,698,108 | 10/1972 | Brunner | 36/11.5 |

FOREIGN PATENT DOCUMENTS

| | | | |
|---|---|---|---|
| 2715906 | 6/1978 | Fed. Rep. of Germany | 12/142 S |

*Primary Examiner*—Patrick D. Lawson

*Attorney, Agent, or Firm*—Watson, Cole, Grindle & Watson

[57] ABSTRACT

Clog-type shoes are produced by combining foamed polymeric soles with conventional vamps by interposing selected adhesives and application of pressure and heat to the assembled clog-type shoe.

8 Claims, 4 Drawing Figures

FIG. 1
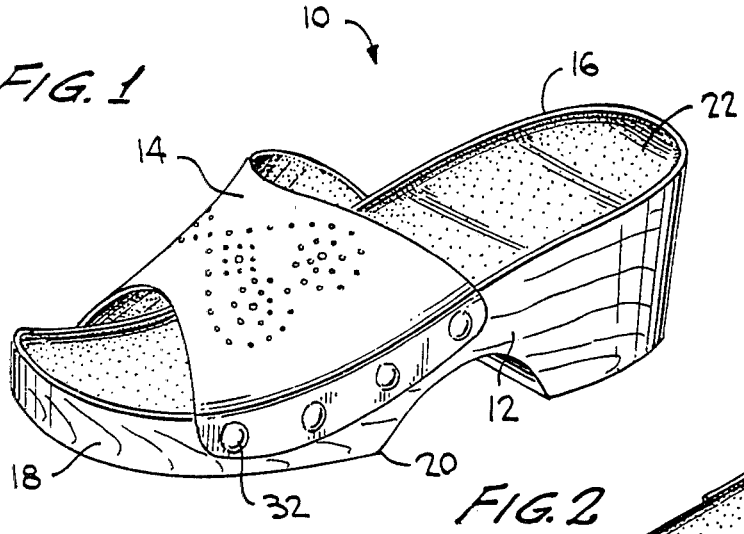
FIG. 2
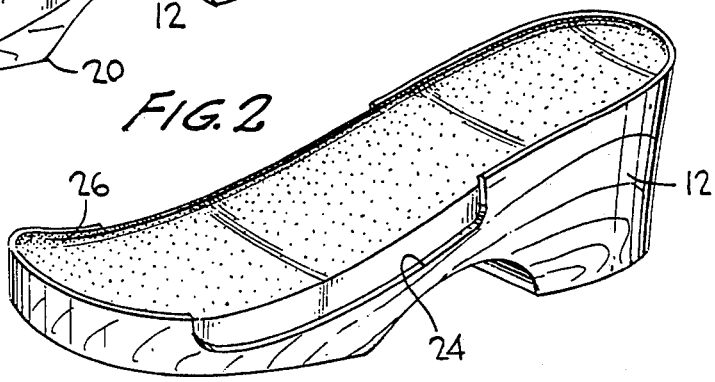
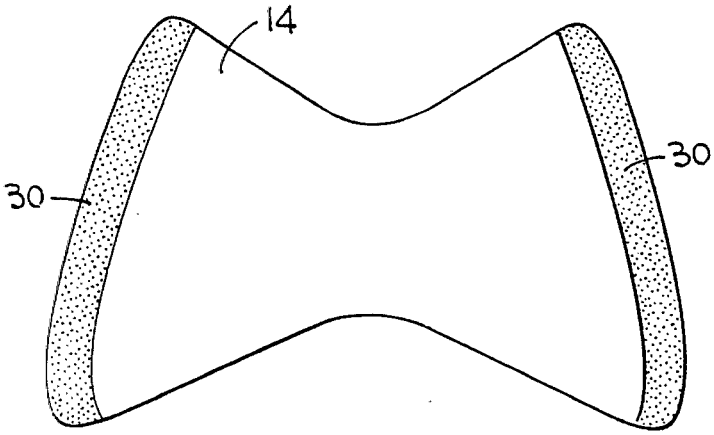
FIG. 3
FIG. 4
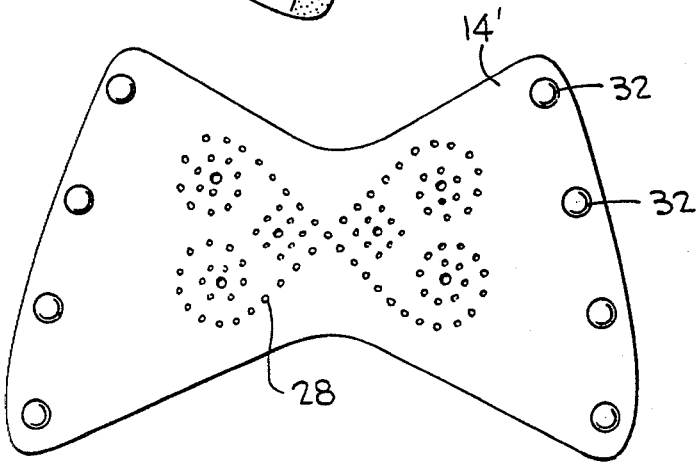

CLOG-TYPE SHOES AND METHOD FOR THEIR PRODUCTION

BACKGROUND OF THE INVENTION

The present invention relates to methods for manufacturing shoes and the shoes formed thereby and, more particularly, relates to the manufacture of clog-type shoes having soles of a foamed polymeric material as opposed to conventional wood soles.

Clog-type shoes for both women and men have enjoyed rapidly increasing polularity over the last several years. These shoes generally have included a carved wooden sole, the upper surface of which is adapted to receive and generally conform to the contours of the foot of the wearer. The sole is usually contoured in a form which includes relatively large heel and ball portions. Attached to the front portion of the sole is a flexible vamp which confines the front end portion of the foot of a wearer. In some styles, the vamp comprises a wide band of flexible material such as leather which provides an open-toed style of clog. Alternatively, the vamp may enclose the entire front portion of the clog.

The general practice in constructing such shoes is to attach the vamp to the wooden sole by overlapping the side edge portions of the vamp onto the sole and there affixing the vamp to the sole by such means as nails, tacks, staples and the like. Because the sole is wood, usually a hardwood, these conventional means for affixing the vamp to the sole are generally satisfactory and long-lasting.

As stated above, clogs have customarily been formed with wooden soles. Regardless of the care which is taken during the manufacturing process, no wooden sole can be formed that conforms precisely to the feet of all wearers as feet tend to differ slightly in their shape and proportions. Therefore, with the rigid base offered by the wooden sole, such clogs have not been comfortable for all individuals to wear. Furthermore, regardless of the degree of fit, standing or walking on such a hard surface for an extended period can and often is tiring and uncomfortable. Several approaches have been attempted to alleviate this problem. Cushioned inserts have been inserted in or affixed to the top of the sole at the heel and ball of the foot. Such techniques allow for retention of the appearance of natural woods, which appearance is believed to be partially responsible for the rise in popularity of this style.

A second proposal is to adapt more conventional modern shoe construction techniques to clog manufacture to bring greater comfort and adaptability to variances in foot configuration to the clog. Due to the mass of the clog sole, many conventional shoe constructions clearly are not acceptable. Moreover, with most, the appearance would be altered markedly or an expensive outer layer for producing that appearance would have to be added.

One recently developed shoe construction, the foamed polymeric sole, allows for the production of an outer surface on the sole that closely resembles the wood of the more conventional clog, yet would afford considerably greater comfort to the wearer. However, if it is desired to manufacture clog-type shoes which utilize such foamed polymeric materials instead of wood for the sole of the shoe to attain greater comfort, a critical problem arises in that all conventional means such as nails for attaching the vamp to the sole will be insufficient since, among other things, nails and the like will tend to be pulled from the foamed poylmeric sole upon use of the shoe. This tendency arises from two facts: (1) clogs by their nature have no strap or other means at the heel portion to draw the shoe against the foot thereby placing a great strain on the vamp, particularly at its rear edge; and (2) due to the resilience of the foamed polymeric material, there is little retentive force exerted on a mechanical fastener.

The soles of synthetic foamed polymeric material conventionally comprise a rigid member about which the foamed polymeric material is formed in molds to the desired shape of the sole. Suitable foamed polymeric materials include foamed urethanes. The appearance of the sole is attained by the dyes in the polymerics and the surface of the mold.

SUMMARY OF THE INVENTION

Accordingly, it is an object of the present invention to provide an improved method for the attachment of a clog-type vamp to a formed sole of foamed polymeric material to produce a clog style shoe.

Another object of the present invention is to provide a clog-type shoe having a foamed polymeric material sole which is constructed so as to facilitate the attachment of a clog-type vamp to the sole.

Briefly, the invention in its broadest aspects comprehends an improved clog-type shoe and the method of its construction. The method produces a clog-type shoe having a sole and a vamp joined to the sole at the forward portion thereof for confining the front portion of a wearer's foot, which method comprises the following series of steps. A sole is formed having the configuration of a conventional clog-type shoe having an upper foot receiving surface, an opposed ground contacting surface and two opposed side surfaces therebetween which are generally perpendicular to the two first-named surfaces and along the length of the sole. A recess is located in each side surface adjacent to the forward portion fo the sole and depending from the upper surface thereof which is adapted to receive a wing portion of the vamp in each such recess. The sole is at least partially formed of a foamed polymeric material. The upper foot receiving surface and the side surfaces within each of the recesses are roughened. An adhesive is applied to the roughened upper foot receiving surface. A sockliner is then placed on the upper foot receiving surface to adhesively attach the sockliner to that surface. Each of the wing portions of the vamp which will mate with the sole at the recesses are skived. An adhesive is applied to each of the roughened recesses and to each of the corresponding skived portions of the wings of the vamp. The adhesive coatings on the sole and vamp are thermally activated. Each of the wing portions of the vamp is spotted in its corresponding recess in the sole. Finally, the vamp and sockliner are pressed against the sole to bond the vamp and sockliner to the sole permanently whereby a clog-type shoe is produced having greatly improved comfort over conventional wooden clogs while having a construction of generally equivalent durability.

The invention further comprehends the improved clog-type shoe that may be produced by the aforementioned method.

Further objects, advantages and features of the present invention will become more fully apparent from a detailed consideration of the arrangement and construction of the constituent parts as set forth in the following description taken together with the accompanying drawing.

BRIEF DESCRIPTION OF THE DRAWING

In the drawing,

FIG. 1 is a perspective view of a improved clog-type shoe in accordance with the present invention, FIG. 2 is a perspective view of a sole for a clog-type shoe according to the present invention prior to attachment of a sockliner and vamp thereto, FIG. 3 is a bottom view of a vamp for a clog-type shoe according to the present invention after having been skived, and FIG. 4 is a top view of an alternative form of vamp for use in the present invention.

DETAILED DESCRIPTION OF THE PREFERRED EMBODIMENTS

In referring to the various figures of the drawing hereinbelow, like reference numerals are used to refer to identical parts of the clog-type shoe of the present invention. Turning initially to FIG. 1, there is shown an improved clog-type shoe in accordance with the present invention which is indicated generally by the reference numeral 10. As shown, the shoe 10 includes a sole 12 and a vamp 14. The sole 10 has an upper foot receiving surface 15, an opposed ground contacting surface 18 and opposed lateral side wall surfaces 20 that are generally perpendicular to surfaces 15 and 18. While the sole 12 is illustratively shown to have a distinct heel 22 of medium height, it should be recognized that the present invention is equally applicable to numerous other sole configurations such as a wedge, low-heel, high-heel and the like.

While the sole 10 may be formed by any of several processes known in the art, it is preferred that it be formed of a synthetic foamed polymeric material such as a foamed polyurethane which encapsulates a stiffening member (not shown). The stiffening member serves to afford appropriate additional rigidity to the sole 10 beyond that provided by the foamed material itself to protect against the sole bending improperly during use by a wearer.

A major benefit that may be obtained through this means of constructing the sole is the detail in the surfaces of the sole which may be controlled by incorporating whatever patterns may be desirable in the surfaces of the mold in which the shoe is formed. In this way the surfaces of the sole may be caused to carry surface variations that resemble the appearance of the wooden soles in conventional clogs. When this is coupled with the ability to dye such foamed materials to desired colors, it is easily seen that soles can thus be created that resemble wooden clog soles very closely yet offer considerably better resilience and prospects for comfort and individual fit.

The shoe 10 further includes a vamp 14 of a flexible web type material such as leather, a porous synthetic polymeric material or the like. As shown in FIG. 3, the vamp 14 has somewhat of a butterfly-shaped appearance which when incorporated into the shoe 10 provides an open-toed type. It should be realized that the vamp 14 can be of a myriad of other suitable shapes so as to provide, for example, a shoe having a closed toe-end portion or one having a plurality of vamp sections as in a style having a series of straps across the toe. Furthermore, a modified vamp 14 may be provided with decorative effects such as a pattern of punched holes or the like as shown in FIG. 4 which holes additionally provide increased ventilation to the foot of the wearer.

The shoe 10 further comprises a sockliner 22 affixed to the upper foot receiving surface 15 of the sole 12. This sockliner is preferably formed of a soft, yet durable sheet material such as leather, fabric or the like. The sockliner acts to smooth any imperfections in the surface 16 and concurrently, along with the resilient sole 12, to adapt the shoe 10 to conform precisely to the foot of the wearer.

In constructing the shoe 10, in accordance with the present invention, the sole 12 as shown in FIG. 2, is molded with recesses 24 in the lateral side surfaces 20 adjacent to the front of the sole. The precise location and dimensions of the recesses 24 is determined by the shape of the vamp 14 to be attached to the sole 12. The recesses may become continuous around the toe of the sole 12 if the vamp 14 is constructed to be closed at the toe. Similarly, if a plurality of straps are used to form the vamp 14, a like plurality of mating inserts are found on each side surface 20.

The recesses 24 serve two primary functions. First, they act to locate the vamp 14 accurately on the sole 12 during the manufacturing process. Second, the recesses 24 are preferably approximately the same depth or slightly greater than the thickness of the vamp 14. As such, the edges of the vamp are protected from abuse during wear, which may significantly increase the useful life of the product.

Moreover, an additional recess 26 is preferably molded into the upper surface 15 of the sole 12. The recess 26 is formed to receive the sockliner 22 and functions in the same manner as the lateral recesses 24 do for the vamp 14.

In producing the shoe 10 in accordance with the present invention, after the sole 12 is molded as described above, the interior of the recesses 24 and 26 are roughened, preferably by use of a wire brush or similar means to provide a surface having improved bonding capabilities.

A coating of a suitable adhesive is next applied separately to the recess 26 and the bottom of the sockliner 22. Thereafter, the sockliner 22 is emplaced in the recess 26. The preferred adhesive is selected to be compatible with the material used for the sole 12. When a foamed polyurethane is used for the sole 12, it has been found that a heat-activated urethane adhesive is preferred. The adhesive should be activated at a temperature of between about 135° and about 150° F. to protect the foamed polyurethane from breakdown. Such an adhesive is manufactured by Compo Chemical Co., Inc., Waltham, Mass. under its designation No. 4100.

The vamp 14 is prepared by first adding whatever decorative effects are desired, such as the pattern of perforations 28 shown in FIG. 4. Thereafter, if the vamp 14 is formed of leather, the wing portions 30 of the vamp are skived to remove a portion of the corium to produce a surface more receptive to bonding to the sole 12.

After skiving the wings 30, the vamp 14 may be provided with a pluarlity of simulated nailheads 32 so that the resulting shoe 10 more closely resembles a conventional wooden-type of clog shoe. These simulated nailheads 32 may simply be hemispherical buttons with depending prongs which are attached to the exterior of the vamp 14 by being pressed against an anvil and thereby do not extend beyond the leather of the vamp 14. The nailheads 32 do not provide means for attachment of the vamp 14 to the sole 12.

The vamp 14 and the sole 12 are prepared for joinder by first applying coats of adhesive to the wings 30 and the recesses 24. Preferably, the adhesive is applied to the corresponding surfaces in two coats. First, a primer coat is applied, either by brush or other suitable means. A particularly useful primer adhesive for use with the foamed polyurethane soles is a urethane adhesive marketed by Compo Chemical Co., Inc. under the designation No. 1479. After the primer has dried, an adhesive, such as Compo's No. 4100, is applied to the mating surfaces.

The adhesive is then thermally activated by exposing the adhesively coated surfaces to a thermal source such as a flash activator. The noted Compo adhesive are activated in the temperature range of about 135° to about 150° F. The vamp wings 30 are spotted in the recesses 24. After spotting, pressure is applied to the top and sides of the sole 12 to force the vamp 14 and the sockliner 22 into a permanent bond with the sole 12. It has been found that a pressure of at least 15 lbs., preferably about 20 lbs., per square inch on the sockliner 22 while simultaneously applying at least 25 lbs., and preferably about 35 lbs., per square inch to the lateral surfaces of the sole 12 is sufficient to ensure good adhesion between the vamp 14, sockliner 22 and the sole 12.

After the adhesive has cured and cooled, the pressure is released and completed shoe is removed. The shoe so constructed is of superior comfort and fit to conventional clog-type shoes, while retaining essentially equivalent styling and durability.

As used herein, the term vamp comprehends the portion of a shoe upper which covers the forepart of the foot and sometimes also extending forward over the top or backward to the back seam of the upper. The vamp 14 may also be formed of two or more pieces that can be joined together by buckles, snaps or the like.

While the present invention has been described with reference to a particular embodiment thereof, it will be understood that numerous modifications may be made by those skilled in the art without actually departing from the spirit and scope of the invention as defined in the appended claims.

I claim:

1. A method for producing a clog-type shoe having a sole and a vamp joined to the sole at the forward portion thereof for confining the front portion of a wearer's foot, the method comprising the steps of forming a sole having the configuration of a conventional clog-type shoe having an upper foot receiving surface, an opposed ground contacting surface and two opposed side surfaces therebetween which are generally perpendicular to the two first-named surfaces and along the length of the sole, a recess is located in each side surface adjacent to the forward portion of the sole and depending from the upper surface thereof adapted to receive a wing portion of the vamp in each such recess, the sole being at least partially formed of a foamed polymeric material, roughening the upper foot receiving surface and the side surfaces within each of the recesses, applying an adhesive to the roughened upper foot receiving surface, placing a sockliner on the upper foot receiving surface to adhesively attach the sockliner to said surface, skiving each of the wing portions of the vamp which will mate with the sole at the recesses, applying a coat of an adhesive to each of the roughened recesses and to each of the corresponding skived portions of the wings of the vamp, thermally activating the adhesive coatings on the sole and vamp, spotting each of the wing portions of the vamp in its corresponding recess in the sole, and pressing the vamp and sockliner against the sole to bond the vamp and sockliner to the sole permanently whereby a clog-type shoe is produced having greatly improved comfort over conventional wooden clogs while having a construction of generally equivalent durability.

2. A method according to claim 1, wherein the adhesive is applied to the roughened recesses and corresponding skived portions of the wings of the vamp in two successive operations by first applying a primer and then an adhesive.

3. A method according to claim 2, wherein the sole is formed of a foamed polyurethane material and the adhesives are urethane adhesives that are thermally activated between about 135° F. and 150° F.

4. A method according to claim 3, wherein simulated nailheads are applied to the outer side of the skived portions of the wings of the vamp prior to pressing the vamp into the roughened recesses in the sole.

5. A method according to claim 4, wherein the simulated nailheads are applied to the vamp by pressing hemispherical buttons having depending prongs thereon through the vamp and against an anvil.

6. A method according to claim 2, wherein a pressure of at least 15 pounds per square inch is applied to the sockliner to bond the sockliner to the sole while a pressure of at least 25 pounds per square inch is applied to the wings of the vamp to bond the vamp to the sole.

7. A method according to claim 6, wherein the pressures applied to the sockliner and vamp during bonding are about 20 and 35 pounds per square inch, respectively.

8. A method according to claim 2, wherein the sole is formed with contours on all lateral surfaces thereof to simulate wood graining and wherein dye is incorporated therein to cause the sole to be colored similar to wood.

* * * * *